US006978730B1

(12) United States Patent
McCarthy

(10) Patent No.: US 6,978,730 B1
(45) Date of Patent: Dec. 27, 2005

(54) MAGNETIC BOAT DOCKING SYSTEM

(76) Inventor: Kevin McCarthy, P.O. Box 960, Sicklerville, NJ (US) 08081

( * ) Notice: Subject to any disclaimer, the term of this patent is extended or adjusted under 35 U.S.C. 154(b) by 0 days.

(21) Appl. No.: 10/874,870

(22) Filed: Jun. 23, 2004

(51) Int. Cl.[7] ..... B63B 9/00
(52) U.S. Cl. ..... 114/221 R; 294/65.5
(58) Field of Search ..... 294/65.5; 114/230.26–230.3, 114/230.15–230.19, 221 R, 230.1, 230.2, 114/230.28, 24 R; 441/3

(56) References Cited

U.S. PATENT DOCUMENTS 408,778 A 8/1889 Wellman
2,943,590 A * 7/1960 Andersen ..... 114/230.1
2,955,561 A 10/1960 Andersen
3,971,329 A * 7/1976 Kosmatka ..... 114/230.22
4,253,697 A * 3/1981 Acosta ..... 294/115
5,690,043 A * 11/1997 Muscara ..... 114/230.23
6,392,517 B1 * 5/2002 Coleman, Jr. et al. ..... 335/285
2004/0051309 A1 3/2004 Perkins

* cited by examiner

*Primary Examiner*—Ed Swinehart
(74) *Attorney, Agent, or Firm*—Norman E. Lehrer

(57) ABSTRACT

A magnetic boat docking system includes an elongated pole having a handle end and a working end and a docking line having a magnetic member attached thereto. The pole has a magnet for attracting the magnetic member of the docking line where the magnet is located adjacent the working end of the pole. The pole also has a hook adapted to aid in grasping the docking line and a rod slidably extending within the pole with the magnet attached thereto in order to retract the magnet within the pole to release the line.

7 Claims, 2 Drawing Sheets

MAGNETIC BOAT DOCKING SYSTEM

BACKGROUND OF THE INVENTION

The present invention is directed toward a magnetic boat docking system and more particularly, toward a pole that aids a person to retrieve a docking line found on a dock using magnetic attraction.

Trying to dock a boat can often be a difficult task, especially if a person on deck is attempting to accomplish the task alone. When there are two people on deck, one person may jump onto the dock and retrieve the line. If someone is already on the dock, the line may be thrown to the person on the deck of the boat. However, if only one person is on the deck and no one is on the dock to help the person, he or she must be able to retrieve the docking line that is located on the dock and use it to guide the boat to the dock in order to secure the boat to the dock. Hooks are available that may be used to grasp the line. This may be a somewhat dangerous and awkward task, especially if the weather is bad. Furthermore, the line may be in a position such as coiled or otherwise lying flat on the dock where the hook cannot grasp the same.

U.S. Pat. No. 408,778 to Wellman discloses the use of electromagnets to dock a boat. Electromagnets are attached to the front, rear, and side of a boat and magnets are attached to the wharf. The attraction of the magnets makes the task of docking the boat easier. However, this system requires the boat and the wharf to be modified in such a way that would be prohibitively expensive.

U.S. Published Patent Application No. 2004/0051309 to Perkins discloses a magnetic docking system where a magnet is attached to a support member that is attached to a boat. A magnet is also attached to the dock. The boat may be docked easily because of the attraction between the magnets. Again, however, the boat and dock must be modified in order for the system to work. Also, the boat and dock must be closely aligned in order for the attraction to occur.

Therefore, a need exists for a system for a safely and easily docking a boat without requiring extensive modifications to either the boat or the dock.

SUMMARY OF THE INVENTION

The present invention is designed to overcome the deficiencies of the prior art discussed above. It is an object of the present invention to provide a docking system that aids a person to dock a boat safely and easily.

It is another object of the present invention to provide a boat pole and a docking line where the pole and the line are magnetically attracted to each other.

In accordance with the illustrative embodiments demonstrating features and advantages of the present invention, there is provided a boat docking system that essentially includes an elongated pole having a handle end and a working end and a docking line having a magnetic member attached thereto, the pole has means for magnetically attracting the magnetic member of the docking line. The attracting means may be a permanent magnet and is located adjacent the working end of the pole. The pole also has a conventional hook adapted to aid in grasping the docking line. In addition, means are provided for retracting the magnet within the pole to thereby release the line. The retracting means includes a rod slidably extending within the pole with the magnet attached to the end of the rod.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form that is presently preferred; it being understood that the invention is not intended to be limited to the precise arrangements and instrumentalities shown.

DETAILED DESCRIPTION OF THE PREFERRED EMBODIMENT

Figure 1:
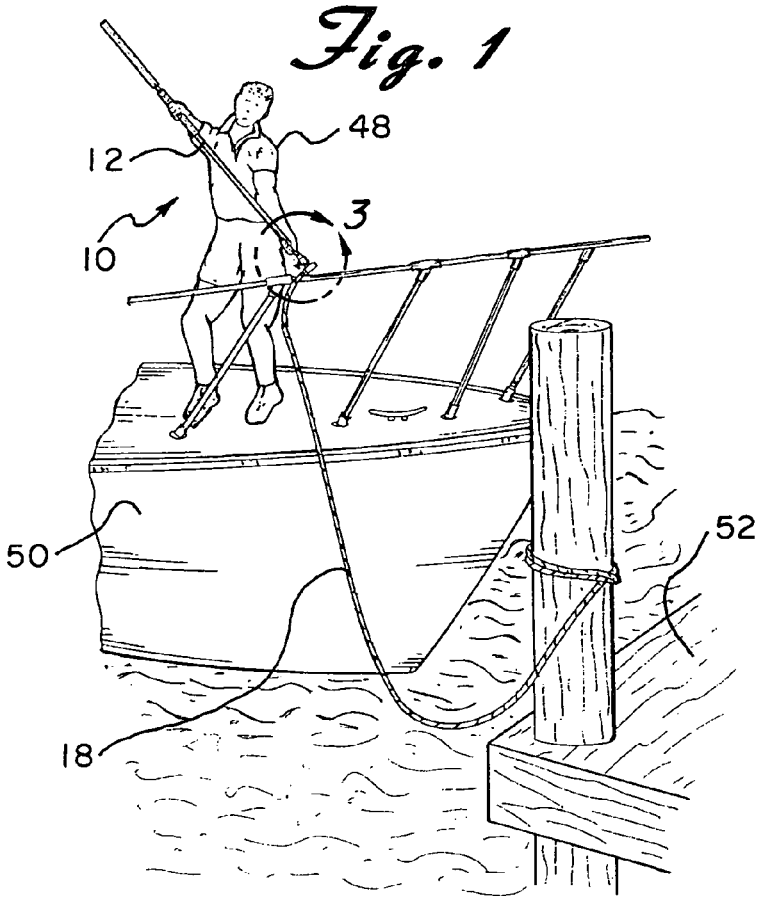
FIG. 1 illustrates the magnetic pole of the present invention being used to aid in docking a boat.
Figure 5:
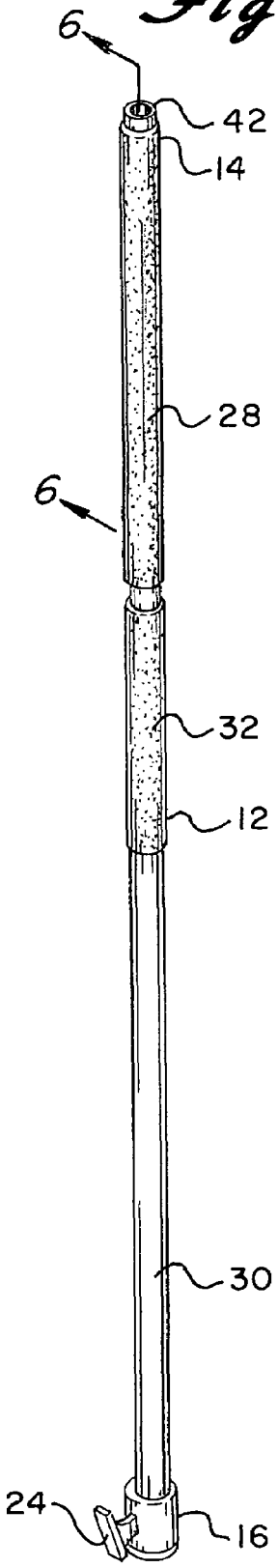
FIG. 5 is a front perspective view of the magnetic pole of the present invention.

Referring now to the drawings in detail wherein like reference numerals have been used throughout the various figures to designate like elements, there is shown in FIGS. 1 and 5 a magnetic boat docking system constructed in accordance with the principles of the present invention and designated generally as 10.

The magnetic boat docking system of the present invention essentially includes an elongated rigid pole 12 having a handle end 14 and a working end 16 and a docking line 18 having a magnetic member 20 attached thereto. The magnetic member 20 is preferably in the form of a tubular sleeve that slides over the line 18 and is secured in any known manner to the same, preferably adjacent the end thereof. The magnetic member 20 may be a magnet or may be made of iron or other material that is magnetically attractable. Furthermore, the magnetic member 20 is preferably coated with a rubber or vinyl like material to help prevent rusting or corrosion.

Figure 3:
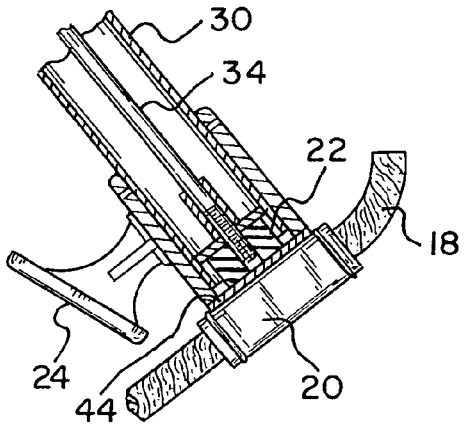
FIG. 3 is a view shown partially in cross-section and taken through line 3—3 of FIG. 1.

The pole 12 has means 22 for magnetically attracting the magnetic member 20 of the docking line 18. The attracting means 22 is preferably a permanent magnet and is located adjacent the working end 16 of the pole 12. The pole 12 also has a hook 24 located adjacent the working end 16. (See FIG. 3.) The hook 24 is adapted to aid in grasping the docking line 18 and is, per se, of substantially conventional construction.

Figure 6:
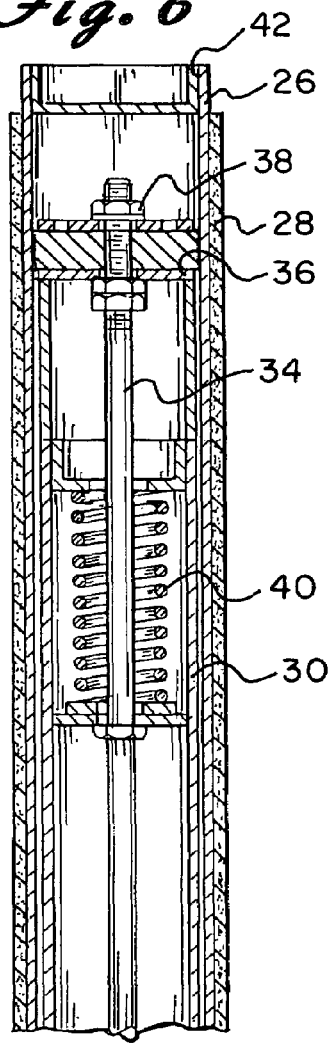
FIG. 6 is a cross-sectional view taken through line 6—6 of FIG. 5.

The pole 12 includes a slidable outer tube 26 with a hand grip 28 and an inner tube 30 telescopingly received within the outer tube 26. The inner tube 30 also has a hand grip 32. (See FIG. 5.) An elongated rod 34 is secured within the outer tube 26 by means of a washer 36 and nut 38 assembly. (See FIG. 6.) The rod 34 extends within the outer tube 26 with the magnet 22 attached to the lower or working end of the rod 34. The outer tube 26 and rod 34 may be used to retract the magnet 22 within the pole 12 as will be described in greater detail below. Attached to the rod 34 is a spring 40 that biases the rod in its extended working position with the magnet 22 adjacent the extreme working end 16 of the pole 12. The top of the outer tube 26 has a cap 42 secured therein. The cap 42 prevents moisture from entering the tube. Similarly, the working end 16 of the pole 12 has a plate 44 secured thereto. By closing both ends of the pole 12, water is prevented from entering the interior thereof. Accordingly, the pole will float should it be dropped into the water.

Figure 2:
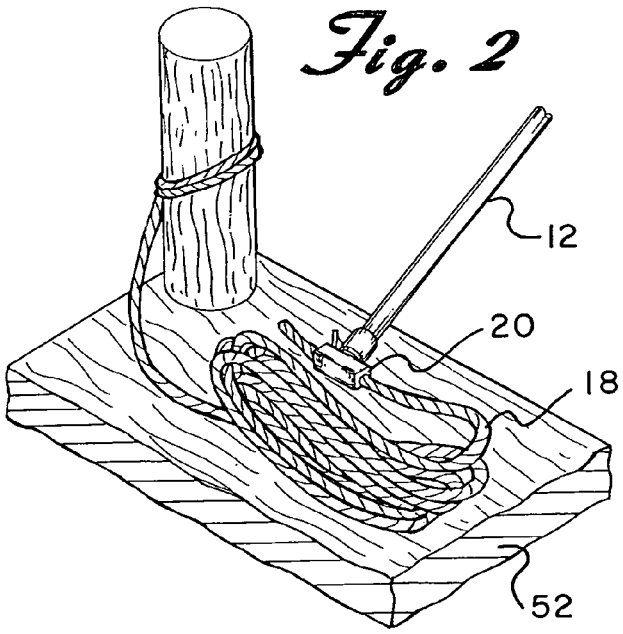
FIG. 2 illustrates the magnetic pole of the present invention magnetically attached to a docking line.
Figure 4:
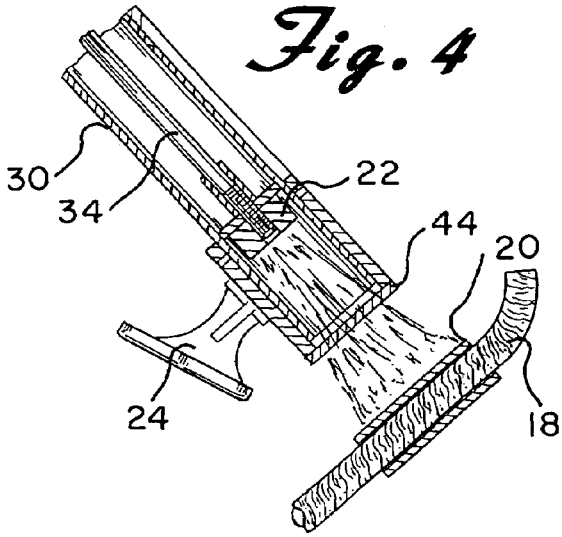
FIG. 4 is a view similar to FIG. 3 illustrating the magnetic attraction between the pole of the present invention and a docking line being released as the magnet of the pole is retracted.

In order to use the pole of the present invention, a person 48 aboard a boat 50 grips the pole 12 and extends the working end 16 of the pole 12 towards the dock 52 and docking line 18. If there is a portion of the line that can easily be snared by the hook 24, the pole 12 can be used in a conventional manner just like any boat hook. If not, the magnet 22 of the pole 12 can be used to attract the magnetic member 20 of the line 18. (See FIG. 2.) The line 18 may now be retrieved by the person 48 on the boat 50. (See FIG. 1.) If the line 18 needs to be released, the outer tube 26 is grasped and pulled back. This action causes the rod 34 to which the magnet 22 is attached, to be retracted, thereby compressing the spring 40. The inner tube 30 remains stationary. As the magnet 22 is retracted, the attraction between the magnet 22 of the pole 12 and the magnetic member 20 of the line 18 is released. (See FIG. 4.) This releasing process may advantageously be used if it is desired to replace the line 18 on a dock or otherwise position the same in some location that cannot be reached by the person 48 aboard the boat.

The present invention may be embodied in other specific forms without departing from the spirit or essential attributes thereof and accordingly, reference should be made to the appended claims rather than to the foregoing specification as indicating the scope of the invention.

I claim:

1. A boat docking system comprising:

an elongated rigid pole having a handle end and a working end;

a docking line secured to a dock and having a magnetic member attached thereto; and a hook adjacent said working end adapted to aid in grasping said docking line, said pole having means for magnetically attracting said magnetic member of said docking line so as to retrieve said line in order to dock a boat, said attracting means being located adjacent said working end of said pole.

2. The boat docking system as claimed in claim 1 further including means for releasing said magnetic member from said working end of said pole.

3. The boat docking system as claimed in claim 2 wherein said releasing means includes said pole having means for retracting said attracting means within said pole and away from said working end.

4. The boat docking system as claimed in claim 3 wherein said retracting means includes a rod slidably extending within said pole, said attracting means being attached to said rod.

5. The boat docking system as claimed in claim 1 wherein said attracting means includes a permanent magnet.

6. The boat docking system as claimed in claim 1 wherein said magnetic member is in the form of a tube that surrounds a portion of said line.

7. A boat docking system comprising:

an elongated rigid pole having a handle end and a working end;

a docking line secured to a dock and having a magnetic member attached thereto;

said pole having means for magnetically attracting said magnetic member of said docking line so as to retrieve said line in order to dock a boat, said attracting means being located adjacent said working end of said pole; and means for releasing said magnetic member from said working end of said pole, said releasing means including said pole having means for retracting said attracting means within said pole and away from said working end.

* * * * *